United States Patent [19]

Armer, Jr.

[11] 4,191,371

[45] Mar. 4, 1980

[54] BALANCING APPARATUS

[76] Inventor: Leon Armer, Jr., 22 Utica St., Brockport, N.Y. 14420

[21] Appl. No.: 869,651

[22] Filed: Jan. 16, 1978

[51] Int. Cl.[2] ..... A63B 23/04

[52] U.S. Cl. ..... 272/111; 272/146

[58] Field of Search ..... 272/96, 97, 109, 111, 272/114, 115, 146, 33 R, 33 A; 280/47.1, 47.12, 47.13, 87.04 R, 87.04 A, 205

[56] References Cited

U.S. PATENT DOCUMENTS

| | | | |
|---|---|---|---|
| 3,306,626 | 2/1967 | Kawada | 272/146 X |
| 3,488,049 | 1/1970 | Sasser | 272/146 X |
| 3,604,726 | 9/1971 | Tracy | 272/146 X |
| 3,612,520 | 10/1971 | Chang | 272/111 X |
| 3,862,768 | 1/1975 | England | 272/146 X |
| 3,984,100 | 10/1976 | Firster | 272/96 |
| 3,995,852 | 12/1976 | Mendelson | 272/111 |

FOREIGN PATENT DOCUMENTS

| | | | |
|---|---|---|---|
| 1419408 | 10/1965 | France | 272/111 |

*Primary Examiner*—Richard J. Apley
*Attorney, Agent, or Firm*—Lawrence P. Kessler

[57] ABSTRACT

A balancing apparatus of the platform and spherical fulcrum type in which the spherical fulcrum is rotatable about its orthogonal axes to enable the fulcrum to move freely over a horizontal surface. A platform support on the spherical fulcrum has a first surface and oppositely facing second surface engaging the spherical fulcrum. A foot support is centrally located on the first surface. A stop means, for defining the extent of movement of the platform relative to the spherical fulcrum, is positioned on the second surface at a location outside the projection of the foot support from the first surface on the second surface.

5 Claims, 4 Drawing Figures

BALANCING APPARATUS

BACKGROUND OF THE INVENTION

1. Field of the Invention

This invention relates generally to balancing apparatus and more particularly to balancing apparatus having a platform supported by a spherical fulcrum.

2. Description of the Prior Art

The use of balancing apparatus has long been recognized as a source of recreational amusement and a beneficial form of exercise. One of the oldest known types of balancing apparatus was the teeter-totter board type balancing platform and log fulcrum. Variations of the board type balancing platform and log fulcrum apparatus are still popular today in such diverse applications as home exercise equipment and apparatus for circus entertainment acts. However, such board type platform and log fulcrum balancing apparatus have the limitations that they are capable only of lateral balancing movement.

Several attempts have been made to expand the recreational and exercise benefits of platform balancing apparatus. An example of the expanded function balancing apparatus is represented by the use of a spherical fulcrum for supporting the balancing platform instead of the log type fulcrum (see, for example, U.S. Pat. Nos. 3,604,726 and 3,862,768). With a spherical fulcrum, the balancing platform is free to move in all directions, thus providing the user with a multiplicity of interrelated balancing movements. However, the spherical fulcrum balancing apparatus, as exemplified by the above noted patents, are either complicated in structure or require an intricately shaped balancing platform. Further since the motion of the platform relative to the fulcrum in these typical balancing apparatus is limited to the area between the feet, the recreational amusement and beneficial exercise derived is proportionately limited.

SUMMARY OF THE INVENTION

It is the purpose of this invention to provide a balancing apparatus of the platform and spherical fulcrum type which is simple in construction and reaches the full potential of recreational amusement and beneficial exercise capable from such type apparatus. The spherical fulcrum is rotatable about its orthogonal axes to enable the fulcrum to move freely over a horizontal surface. A platform support on the spherical fulcrum has a first surface and oppositely facing second surface engaging the spherical fulcrum. A foot support is centrally located on the first surface. A stop means, for defining the extent of movement of the plateform relative to the spherical fulcrum, is positioned on the second surface at a location outside the projection of the foot support from the first surface on the second surface.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
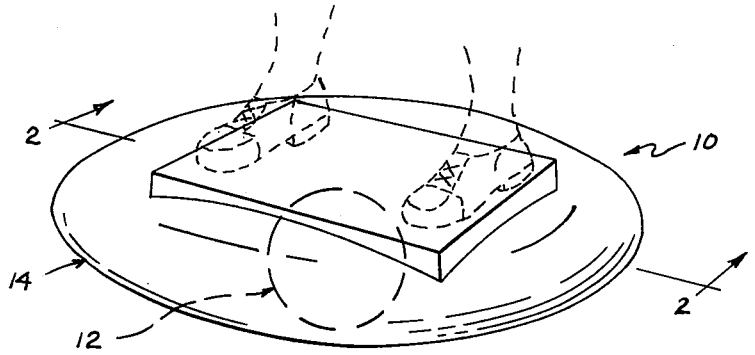
FIG. 1 is a perspective view of the balancing apparatus of this invention being used for recreational movement and exercise purposes.
Figure 2:
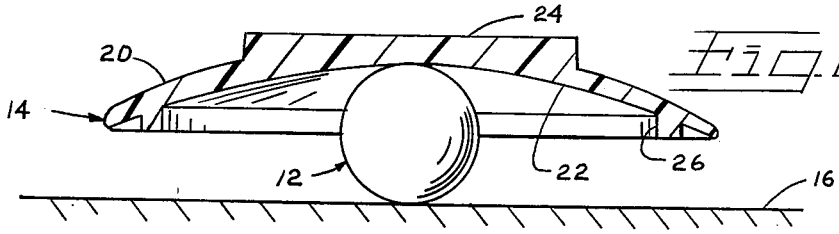
FIGS. 2 through 4 are side elevational views of the balancing apparatus of this invention, taken in section on lines 2—2 of FIG. 1, showing the extent of movement of the platform relative to the spherical fulcrum.
Figure 3:
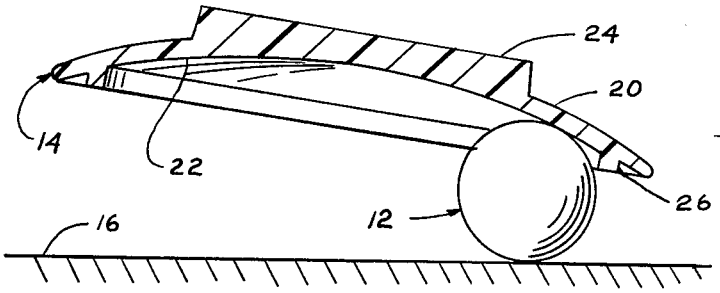
Figure 4:
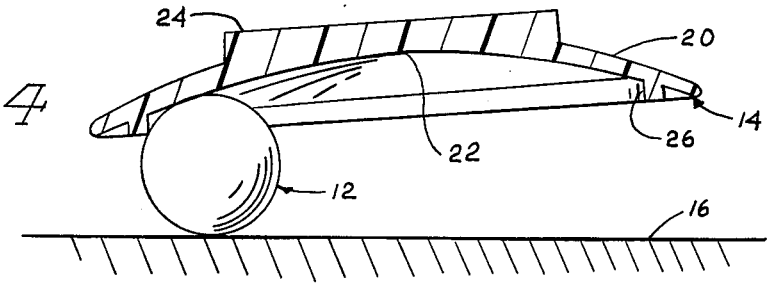

Referring now to the drawings, the recreational amusement and exercise apparatus 10 according to this invention has a spherical fulcrum 12 for supporting a platform 14. The spherical fulcrum 12 is in the configuration of a ball of very hard material such as wood or rubber, preferably between 3 to 5 inches in diameter. When placed on a horizontal surface 16, it is freely rotatable about its orthogonal axes to move in any direction over the horizontal surface. The platform 14 is formed of a single molded piece of plastic material, such as polypropelene.

The main body of the platform 14 is in the shape of a sector of a sphere having an external convex surface 20 and an internal concave surface 22. The diameter of the sector of the sphere is substantially greater than that of the spherical fulcrum 12. It has been found that for optimum interrelational movement of the platform relative to the spherical fulcrum, the diameter of the sector of the sphere of the platform should be proportional to the diameter of the spherical fulcrum in the ratio of about 24:1. For example, the diameter of the sector may be about 96 inches when the diameter of the spherical fulcrum is 4 inches, with a chord diamension of the sector being about 20 inches.

A foot support 24 is centrally located on the external convex surface 20. The support is just large enough to comfortably accommodate the feet of the largest typical user (see FIG. 1); for example, about 16 inches square. A stop 26 is located on the internal concave surface 22 for defining the extent of movement of the spherical fulcrum 12 with respect to the platform 14. The stop 26 is a raised ridge, which along with the support 24, which may be integrally molded with the body of the platform 14 as a unitary structure. The raised ridge extends outwardly from the concave surface 22 at a location outside the projection of the foot support 24 from the convex surface 20 on the concave surface 22. The interaction of the raised ridge of the stop 26 with the spherical fulcrum 12 prevents the platform 14 from dis-engaging the fulcrum during normal use of the apparatus 10.

To operate the recreational amusement and exercise apparatus 10, the spherical fulcrum 12 is placed on the substantially horizontal surface 16 for free movement about its orthogonal axes and the platform 14 is mounted on the spherical fulcrum. The user mounts the platform 14 by placing his feet on the foot support 24. Once the user obtains his balance, he may generate translational movement of the apparatus 10 is any direction by movement of his torso and extremities.

The particular placement of the stop 26 outside the projection of the foot support 24 gives the apparatus 10 its unexpected recreational amusement and exercise attributes over those presented by heretofore available apparatus. That is to say, by movement of the lower torso and upper portion of the legs, the user may cause the apparatus to translate in such a way as to duplicate the actions found in skiing, skating, skateboarding or the like. This unique sport duplicative action has been found possible only where the spherical fulcrum, although limited in its movement relative to the balancing platform, is free to move outside of the projection of the feet of the user. The resulting recreational amusement is more stimulating than possible with the prior known apparatus. Further, it results in far more beneficial exercise, such as enabling skiiers, skaters or skateboarders to enjoy and practice the physical moves required by their respective activities when actual participation is not possible due to space or weather limitations.

The invention has been described in detail with particular reference to a preferred embodiment thereof, but it will be understood that variations and modifications can be effected within the spirit and scope of the invention.

I claim:

1. Balancing apparatus for providing recreational amusement and beneficial exercise to the user, said apparatus comprising:

a spherical fulcrum of a first diameter, said spherical fulcrum being rotatable about its orthogonal axes to freely move over a horizontal surface;

a platform supported by said spherical fulcrum and movable relative to said spherical fulcrum in a plurality of directions in the plane of the platform, said platform having a first surface and an oppositely facing second surface engaging said spherical fulcrum;

a foot support centrally located on said first surface; and stop means for engaging said spherical fulcrum to limit movement of said platform for all directions of movement of said platform relative to said spherical fulcrum, said stop means being positioned on said second surface at a location outside the projection of said foot support from said first surface on said second surface.

2. The invention of claim 1 wherein said platform is formed as the sector of a sphere, said sector having an external convex surface defining said first surface and an internal concave surface defining said second surface.

3. The invention of claim 2 wherein said sector of the sphere forming said platform is of a second diameter substantially larger than said first diameter in a ratio of 24:1.

4. The invention of claim 2 wherein said platform, foot support and stop means are integrally formed as a unitary structure.

5. The invention of claim 1 wherein said stop means includes a raised ridge extending outwardly from said platform.

* * * * *